US005139210A

United States Patent [19]

Schaffer

[11] Patent Number: 5,139,210

[45] Date of Patent: Aug. 18, 1992

[54] DISPENSING ASSEMBLY AND METHOD FOR COILED ELECTRICAL WIRE

[76] Inventor: Henry D. Schaffer, 103 Reservoir Dr., San Rafael, Calif. 94901

[21] Appl. No.: 803,226

[22] Filed: Dec. 6, 1991

[51] Int. Cl.[5] ..... B65H 49/18; B65H 55/00

[52] U.S. Cl. ..... 242/129; 242/159; 242/171; 294/137

[58] Field of Search ..... 242/129, 129.5, 130, 242/132, 134, 137, 137.1, 138, 146, 159, 170, 171, 1; 206/225, 389, 397, 409, 413, 415, 416

[56] References Cited

U.S. PATENT DOCUMENTS

| | | | |
|---|---|---|---|
| 1,431,352 | 10/1922 | Abbott | 242/129 X |
| 2,965,331 | 12/1960 | Nagy | 242/138 |
| 3,125,312 | 3/1964 | McDuffie | 242/129 |
| 3,390,844 | 7/1968 | Dillow et al. | 242/129 |
| 3,593,943 | 7/1971 | Collmann | 242/129 |
| 3,667,699 | 6/1972 | Hobbs et al. | 242/129 |
| 3,837,597 | 9/1974 | Bourhenne | 242/129 |
| 3,974,980 | 8/1976 | Marcell | 242/129 X |
| 4,471,921 | 9/1984 | Corbin | 242/129 |
| 4,715,549 | 12/1987 | Travlos | 242/129 X |
| 4,826,100 | 5/1989 | Belliveau | 242/129 |
| 4,844,376 | 7/1989 | Maraman, Sr. | 242/129 |

*Primary Examiner*—Stanley N. Gilreath
*Attorney, Agent, or Firm*—Flehr, Hohbach, Test, Albritton & Herbert

[57] ABSTRACT

A wire dispensing apparatus (10) and method for dispensing wire or sheathed electrical cable (14) from an annular coil (13) mounted within a storage container (12). The wire dispensing apparatus (10) includes a support axle (24) dimensioned for insertion into a central opening (16) of the coil, and having opposed ends (28, 30) and a length dimension (L) therebetween which is at least about equal to the height dimension (H) of the coil (13). The wire dispensing apparatus further includes a coil retaining assembly (34) which is mountable to the exterior of the container (12), generally in alignment with the opposed ends (28, 30) of the support axle (24) cooperate with the axle (24) to retain or hold the container side walls (20, 22) against the axle ends (28, 30). The axle (24) and retaining assembly (34) prevent the wire from passing over the axle ends (28, 30) and becoming twisted as it is dispensed and prevent the wire (14) from pulling down between the sides of the coil (13) and the side walls (20, 22) and becoming jammed inside the container. The wire dispensing method includes the steps of inserting a support axle (24) into the central opening (16) of a coil (14) while the coil (14) is positioned within a storage container (12), and mounting an axle retaining device (34) to the exterior of the container (12) in a position cooperating with the coil support axle (24) to prevent the passage of wire around the ends (28, 30) of the coil support axle (24) and between the coil sides and the container side walls (20, 22) when dispensing wire from the container (12).

17 Claims, 4 Drawing Sheets

DISPENSING ASSEMBLY AND METHOD FOR COILED ELECTRICAL WIRE

TECHNICAL FIELD

In general, the present invention relates to an assembly and method for dispensing wire, cable and filamentous material. More particularly, the present invention relates to a dispensing assembly and method which may be used for storing, transporting and dispensing coiled, sheathed cable or electrical wire.

BACKGROUND ART

Electrical wire, and particularly non-metallic sheathed cable containing a plurality of side-by-side wires, is most often supplied to electricians in wound coils consisting of approximately 250 feet of cable. The coils of sheathed cable are usually supplied by manufacturers in rectangular cardboard containers. By pulling on the center lead end, a desired length of cable may be removed from the coil and cut to length. An early example in the patent art of a carton from which coiled conduit can be dispensed is shown in U.S. Pat. No. 1,431,352. Dispensing sheathed cable in this manner, however, produces helical twists in the cable, which can result in kinking. Sheathed cable is widely available in a three-conductor form having a round transverse cross-section and in a two-conductor form having an elongated transverse cross-section. Twisting of either form of sheathed cable can cause kinking and makes installation more difficult. In sheathed cable, the kinks are totally unacceptable. Constant attention to cable payout slows the electrician's pace considerably as he removes the periodic twists from the cable and guards against kinks.

Various attempts have been made to enhance coiled wire payout from storage containers. Thus, in U.S. Pat. Nos. 3,125,312, 3,390,844 and 3,667,699 coils of wire are dispensed from rectangular containers having central coil supporting structures. In all of these wire dispensing assemblies, the wire is payed out off the innermost coils over the end of the coil support structure. Thus, the wire inherently is dispensed from the container with twists in it. This may be acceptable for some applications, for example, bailing wire, single electrical wires or concrete reinforcing strand, but it does not solve the problem of twisting and kinking of sheathed electrical cable, and even single strand electrical wire is at risk for kinking if it is twisted.

As an alternative to dispensing wire or cable from its cardboard container, an electrician may place the wire or cable in a turntable-type dispensing device. While such turntable dispensers are not extensively used by electricians, they have been the subject of patent effort. U.S. Pat. Nos. 3,593,943 and 3,974,980 disclose turntable dispensers in which the container with the cable or wire in it is mounted on a turntable. In U.S. Pat. Nos. 2,965,331, 4,471,921, 4,826,100 and 4,844,376, the wire or cable is removed from its container and mounted on a turntable. In both approaches, the wire is unwound from the outermost coils and the turntable is free to rotate and thereby prevent the formation of unwanted twists or kinks. The electrician can concentrate completely on the actual installation of the wire. The job is finished faster, and the danger of unobserved kinks occurring in the wire is eliminated.

Electrical wiring specifications typically require that several different gauges of wire be installed during construction. In this situation, the electrician must work with several different coils of wire. If a turntable dispenser is used, each time the electrician wishes to dispense wire from a different coil, he needs to reload the dispensing device. He must return to the turntable, rewind the wire which has been payed out but not used, remove the old coil, and mount a new coil on the turntable. To preserve the integrity of the old coil and prevent tangling of the wire, the old coil must be protected against uncoiling or returned intact to its container. Similarly, when cleaning up at the end of a job, the unused wire or cable must be returned to its container or secured against uncoiling for storage and transport to and from the installation site. Additionally, turntable dispensers of the type in which the container with the wire in it is mounted on the turntable tend to be undesirably bulky and complex, and therefore have storage and cost disadvantages. Similarly, turntable dispensers which receive the wire coil are often undesirably complex and costly.

Turntable wire dispensers also are available in stud-mounted versions. An example of a stud-mounted turntable dispenser is disclosed in U.S. Pat. No. 3,837,597. The stud-mounted turntables, however, are difficult to move and must be periodically moved closer to electrician's working area as the wiring job progresses. Moreover, stud-mounted dispensers often cannot be used for remodeling jobs, since building studs frequently are not exposed and available a support structures.

Finally, wire reels are known in which wire can be wound on the reel or spool and thereafter unwound. U.S. Pat. No. 4,715,549 is typical of such a prior art device, but unless the wire or cable is wound onto the reel without twists it has little usefulness.

Accordingly, a wire dispensing assembly which dispenses wire or sheathed cable from a coil positioned within its original storage container without twisting or kinking the wire or cable is highly desirable. A wire or cable dispenser which is low in cost, easily installed, portable, and which can be positioned on a standard wire caddy also would be desirable. Similarly, a method which converts an ordinary storage container into a twist-free dispensing apparatus for a coil of wire or cable would be extremely useful.

A primary object of the present invention, therefore, is to provide a wire dispensing system for a coil of wire or sheathed cable positioned within a storage container which dispenses wire without any twists.

Another object of the present invention is to provide a wire dispensing system for conveniently storing, transporting and twist-free dispensing wire or cable from a coil.

A further object of the present invention is to provide a wire dispensing system which is portable for easy transport and use, and which additionally may be placed on a wire caddy or stud-mounted support assembly to dispense wire from a fixed location.

A more general object of the present invention is to provide a system for conveniently transporting apparatus such as a wire dispenser.

The apparatus and method of the present invention have other objects and features of advantage which will become apparent from and are set forth in more detail in the description of the Best Mode Of Carrying Out The Invention and the accompanying drawings.

DISCLOSURE OF THE INVENTION

The apparatus of the present invention for dispensing wire or sheathed cable from an annular coil mounted within a storage container includes a support axle and a retaining device. The support axle is dimensioned for insertion into the central opening of the coil, which is defined by the innermost loops of the wire or cable. The support axle has a length dimension which is at least about equal to the distance between the opposed side walls of the storage container. The retaining device is mountable to the exterior of the side walls of the container, generally aligned with opposed ends of the support axle. The retaining device, mounted to the container, cooperates with the support axle to support the container opposed side walls in a stable position in close proximity to the ends of the axle so as to permit rotation of the coil on the axle and to prevent the wire or cable from jamming between the coil and the side walls or passing between the opposed axle ends and the adjacent opposed side walls of the container. The support axle and retaining device allow the container to be converted into a spool or reel upon which the coil will rotate to payout wire off the outermost coils without twisting.

In another aspect of the present invention, a method for converting a wire storage container into a wire dispenser for dispensing an annular coil of wire stored within the container is provided. The method includes the steps of inserting a support axle into the central opening of the coil while the coil is positioned within the container, and mounting an axle retaining device to the exterior of the container. The retaining device is mounted to the container at a position for cooperating with the support axle to prevent the passage of wire around either end of the support axle as wire is unwound from the coil. When the outermost end of the coil is pulled, the coil rotates on the axle inside the container to provide dispensing without twisting.

BEST MODE OF CARRYING OUT THE INVENTION

Figure 1:
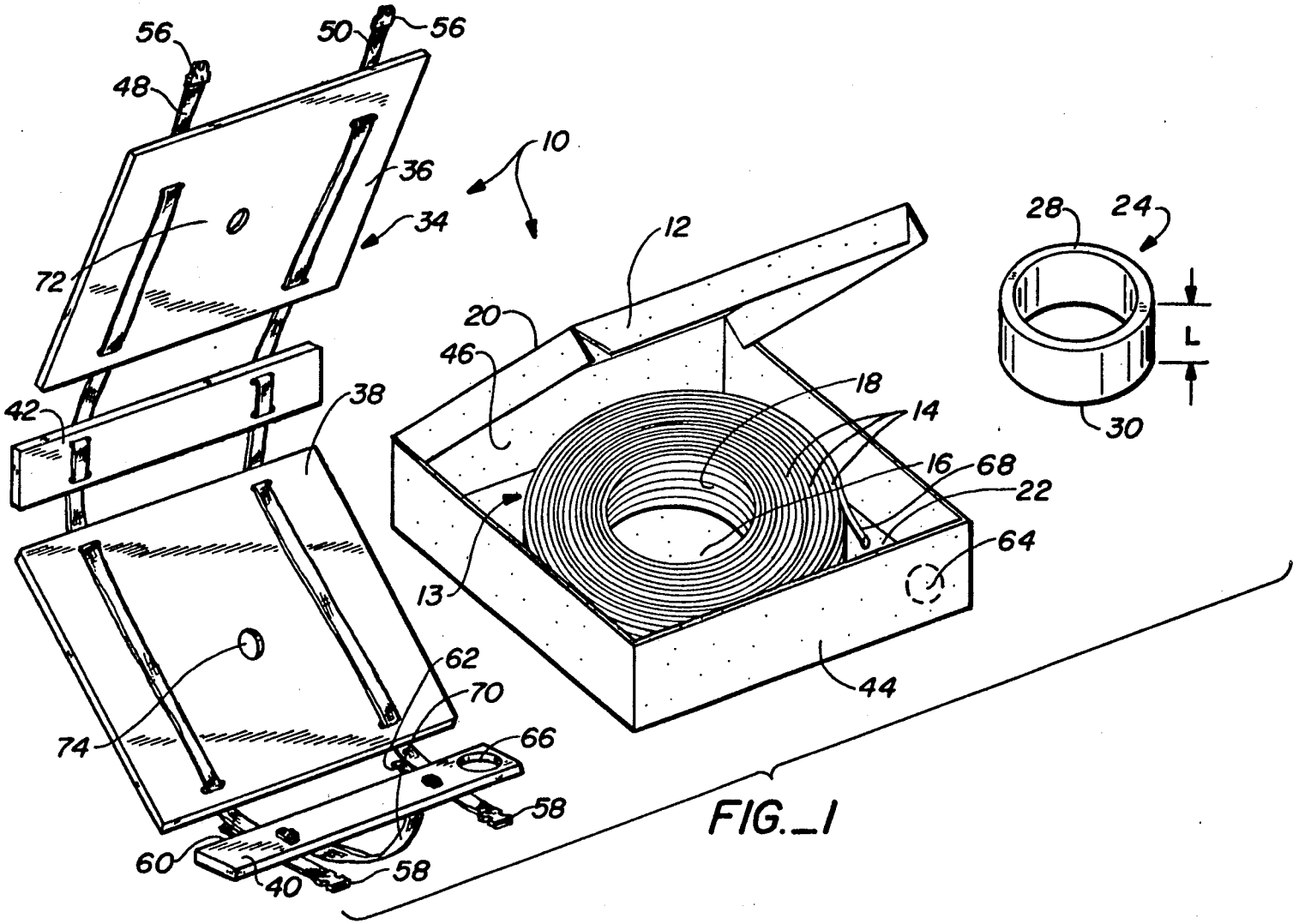
FIG. 1 is a top perspective exploded view of a retaining device and a support axle constructed in accordance with the present invention together with a storage container holding, an annular coil of wire.

Reference will now be made in detail to the preferred embodiments of the invention, which are illustrated in the accompanying Figures. Turning now to the drawings, wherein like components are designated by like reference numerals throughout the various figures, attention is directed to FIGS. 1 and 2.

The apparatus of the present invention is adapted for use with a coil of electrical cable or wire stored within a container, usually a cardboard container, so that the container can be converted into a wire dispenser. The apparatus 10, for converting a wire container into a wire dispenser, which is constructed in accordance with the present invention, is shown in FIG. 1 before mounting to wire storage container 12 and is shown mounted to container 12 in FIG. 2.

An annular coil 13 of wire or sheathed electrical cable 14 is housed within container 12. Central opening 16 of coil 13 is defined by innermost loops or coils 18 of wire. The central opening of coil 13 is oriented to extend between spaced apart, opposed side walls 20, 22 of the container, and in most cases the height dimension of coil 13 is substantially equal to the distance between opposed sides 20, 22 of container 12.

In the preferred use of wire dispensing apparatus 10, storage container 12 is the container which originally held coil 13 at the time of purchase. However, other types of storage containers may be substituted for the original packaging.

In order to support opposed sides 20, 22 of the container in a position enabling dispensing of cable 14 from coil 13 without twisting of the cable, the wire dispensing apparatus of the present invention includes support means, such as support axle 24, shown in FIG. 1. In the illustrated embodiment, support axle 24 has a round, tubular cross section. However, coil support means having other geometries, for example a solid rod or a hexagonal member, are within the scope of the present invention.

Support axle 24 is transversely dimensioned to fit within central opening 16 of the coil of wire or cable. As may be seen in FIG. 3, however, axle 24 may have a diameter which is significantly less than the diameter of central coil opening 16. The primary function of axle 24 is to control the position of or support side walls 20 and 22. Support axle also supports the coil during rotation. Thus, once inserted in place, coil 13 may rotate about support axle 24 as the wire is payed out the coil or axle 24 can rotate together with coil 13 inside container 24. Sheathed electrical cable is largely self-supporting when in a coiled condition; but as the inner end of a coil of sheathed cable is reached, the support axle also prevents innermost loops 18 from collapsing into central opening 16 as the outer coils are payed out.

In order to perform its support function, support axle 24 has a length dimension L which is about equal to the height dimension H (FIG. 3) of coil 13. When in position, opposed ends 28, 30 of axle 24 preferably are about equal to the height dimension of coil 13. Thus, ends 28, 30 contact and support each of the opposed side walls 20, 22. While in the ideal situation the opposed ends will abut opposed side walls 20, 22, the length dimension can be somewhat shorter than the coil height and/or distance separating the opposed side walls. In other embodiments of the present invention, length dimension L will be slightly greater than the coil height and/or distance between opposed side walls 20, 22.

If length L of axle 24 is too short relative to coil 13, the wire or cable will be squeezed between opposed sides 20, 22 by retainer assembly 34, and coil 13 will not be able to rotate on or with axle 24. If length L of axle 24 is too long, outer wire coils can become jammed between sides 20, 22 and the sides of coil 13. If the space between coil 13 and side walls 20, 22 is not greater than about one-half the largest transverse dimension of the cable 14, it will be difficult to pull the cable down between coil 13 and side walls 20, 22, and if the space is not greater than one-half the smallest transverse dimension, it will be virtually impossible to jam the wire between the container side walls and the coil. Accordingly, as used herein the expression "about equal to the height dimension of the coil" shall mean that the length of axle 24 is sufficiently long to prevent squeezing of the coil by an amount significantly impeding rotation of the coil and is sufficiently short so that sides 20, 22 are not spaced from the sides of the coil by an amount enabling the wire or cable to be pulled down and jammed between the coil and the opposed container sides walls.

Figure 4:
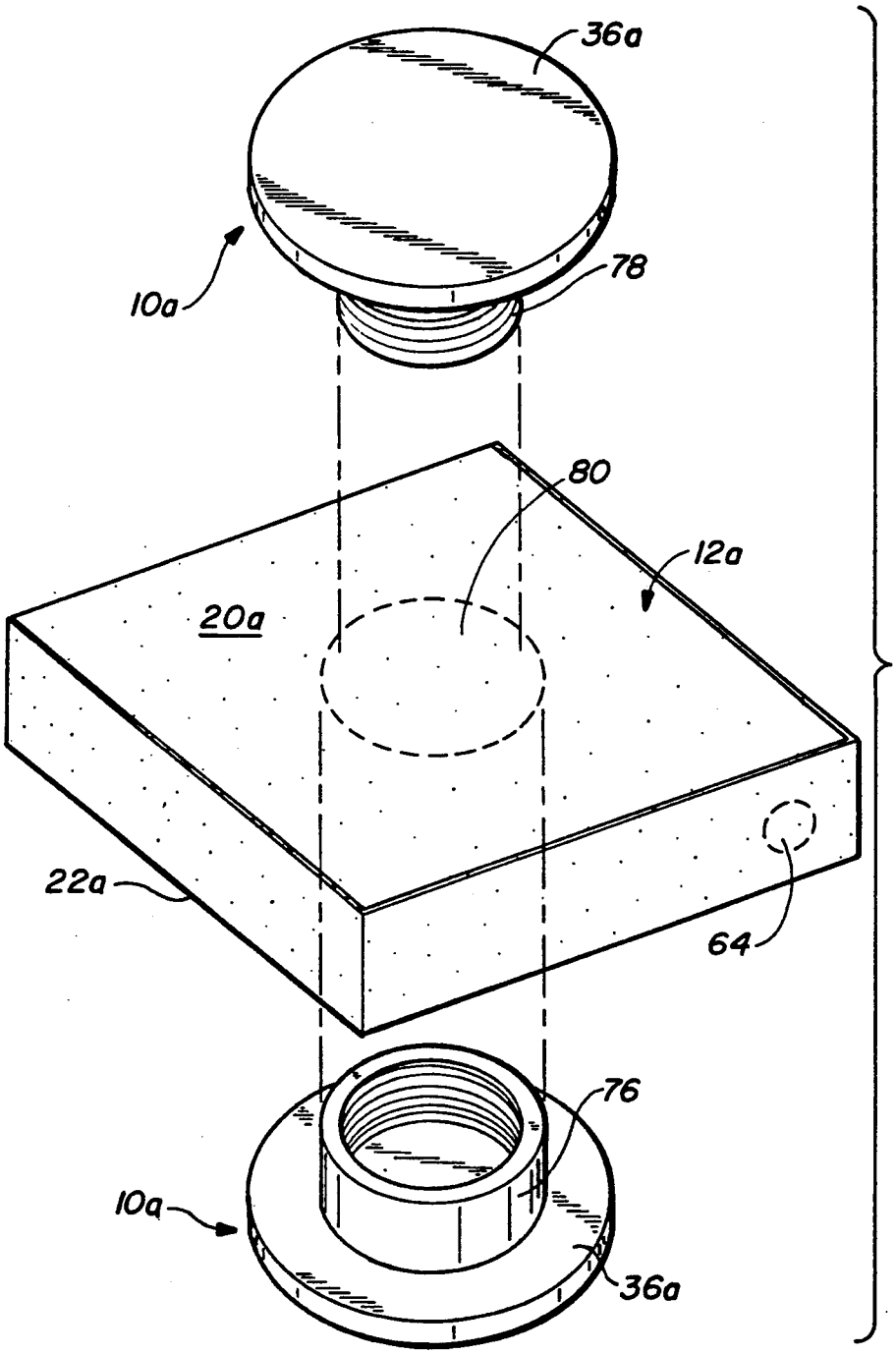
FIG. 4 is a top perspective exploded view of an alternative embodiment of the wire dispensing apparatus of the present invention shown with a storage container housing an annular coil of wire.

In the embodiment of FIG. 4, axle 76, 78 extends through each side wall, but flanges 36*a* on the axle member are positioned relative to the axle to retain opposed side walls 20*a*, 22*a* at a position so that the effective length of the axle inside container 12*a* is "about equal to the height dimension of the coil".

In order to further control the position of container side walls 20 and 22, wire dispensing apparatus 10 further includes coil or axle retaining means, such as coil retaining assembly 34. The coil retaining assembly shown in FIGS. 1-3 includes first and second retaining members 36, 38 which are positioned adjacent opposed side walls 20, 22 when wire dispensing apparatus 10 is mounted to the container. The retaining assembly optionally further includes third and fourth retaining members 40, 42 located between the first and second retaining members and positioned against opposed end walls 44, 46 of the container. Adjustable straps 48, 50 link the retaining members together, and releasable fastening clip assemblies 52, 54, including male and female members 56, 58, are attached to the ends of each of the adjustable straps. Fastening clip assemblies 52, 54 can be of the type widely used on strap in the backpacking industry.

To mount retaining device 34 to the container, the first and second retaining members are placed against opposed side walls 20, 22, while the third and fourth retaining members are positioned adjacent opposed end walls 44, 46. The adjustable straps are wrapped around the container with the ends held together by fastening clips 50, 52. To secure the retaining members in place, adjustable straps 48, 50 are tightened about the container by pulling loose ends 60, 62.

Figure 5:
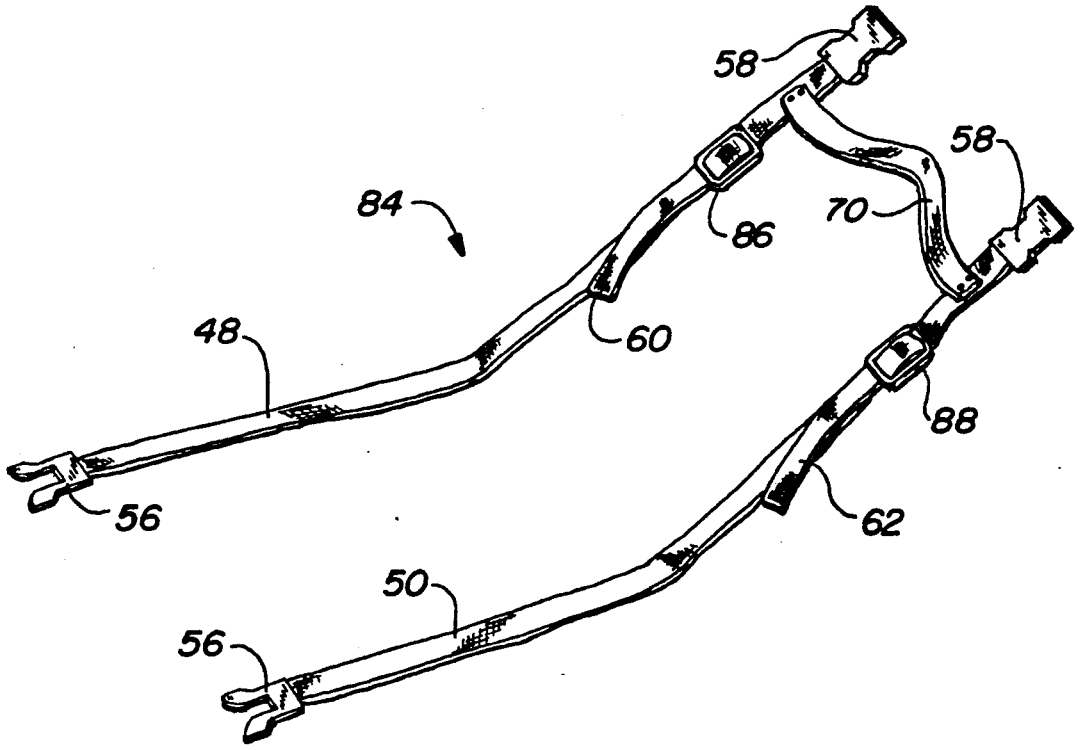
FIG. 5 is a top perspective view of an alternative embodiment of the carrying strap assembly constructed in accordance with the present invention and suitable for carrying the wire dispensing apparatus of FIGS. 1 and 4.

Before dispensing wire, a hole must be cut in the container for drawing the wire or cable from within the box. In the present embodiment, hole 64 is cut in opposed end wall 44, as indicated by the broken lines. The location of hole 64 is aligned with opening 66 in third retaining member 40. Lead end 68 of an outermost coil, therefore, may be threaded through hole 64 and opening 66. The wire or cable is dispensed from the container by pulling lead end 68 and feeding the wire or cable through opening 66 in member 40, which prevents tearing or fraying of the container at the edges of hole 64. Container support member may also have a handle 70 mounted thereto, here shown as a strap-like handle, but rigid and other forms of flexible handles are suitable. Handle 70 also may be carried by the strap assembly, as is shown in FIG. 5.

Figure 2:
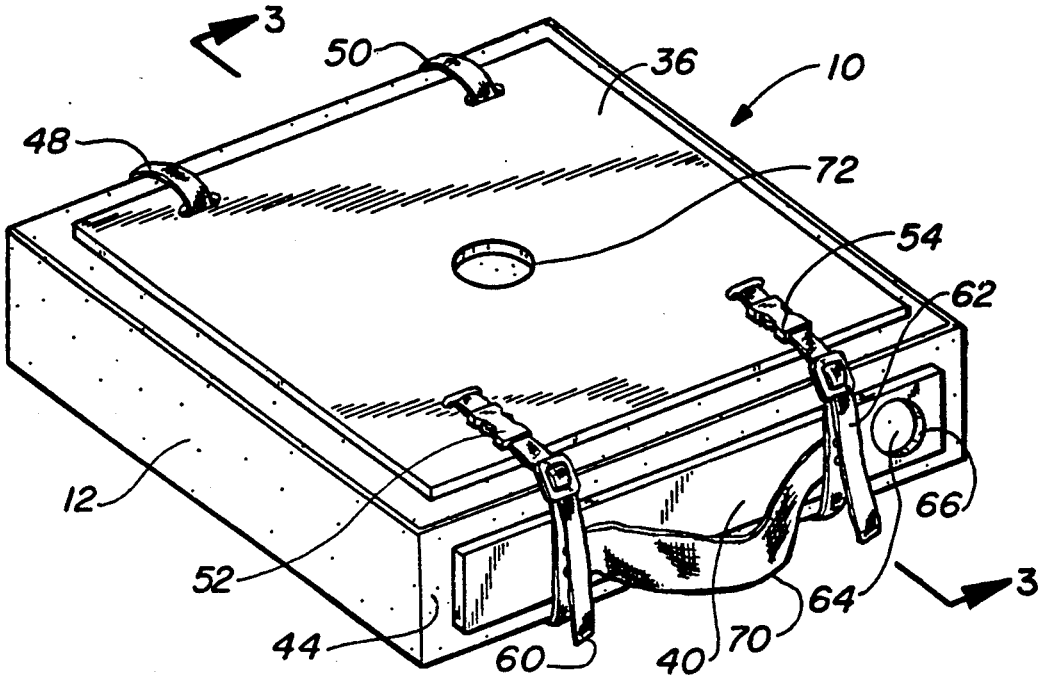
FIG. 2 is a top perspective view of a wire dispensing apparatus of FIG. 1 shown mounted to the storage container stet an annular coil of wire.
Figure 3:
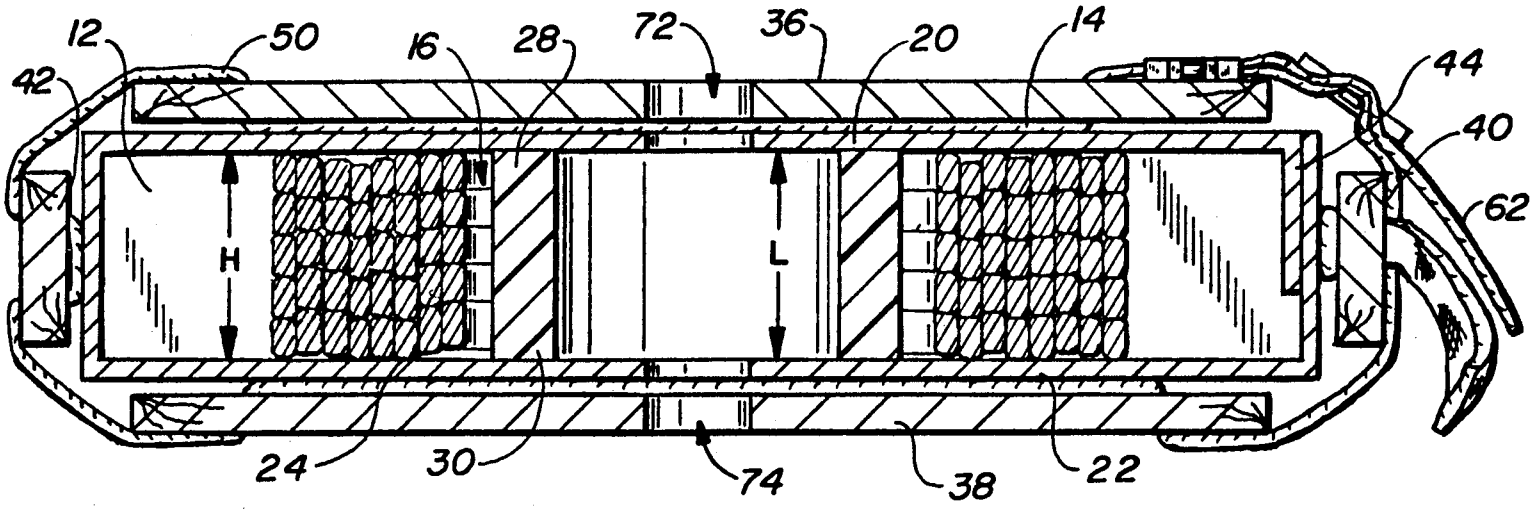
FIG. 3 is a cross sectional view of the wire dispensing apparatus taken along line 3—3 in FIG. 2.

In the embodiment of FIGS. 1-3, retaining means or assembly 34 is shown having four container supporting members, namely members 36, 38, 40 and 42. Retaining means 34, however, need not include support members 36, 38, 40 and 42, as long as opposed side walls 20 and 22 of container 12 are retained, supported or held in sufficiently close relationship to ends 28 and 30 of axle 24 that the wire or cable cannot pass between sides 20 and 22 and axle ends 28 and 30 or jam between the sides of coil 13 and the side walls. For some cartons, therefore, members 36, 38, 40 and 42 can be eliminated, and a strap assembly as shown in FIG. 5 will provide sufficient support for carton sides 20, 22. Even when side support members 36 and 38 are employed, end retaining members 40 and 42 can be eliminated within the scope of the present invention.

First and second retaining members 36 and 38 in the illustrated embodiment of FIGS. 1-3 are solid rectangle members. Alternative shapes and configurations may be substituted, as will become apparent from the description of the cooperation between the retaining device and the support axle. In the present embodiment, two adjustable straps are used to link the retaining members together and secure the retaining device to the container. The scope of the present invention is not meant to be restricted to the use of straps. The retaining device may include one, or any number of straps. Moreover, fastening clips 52, 54 may be replaced with other releasable fastening means well known in the art for fastening the ends of each adjustable strap together. Additionally, the strap assembly also can be eliminated if alternate retaining means are provided. One example of an alternate retaining means would be a bolt extending through aperture 72 of first retaining member 36, through container side 20, through support axle 24 parallel to the axis of the support axle, through opposed container side 22, and through aperture 74 of second retaining member 38. The bolt would be secured by a nut on one end and the bolt head on the other, both of which should be larger than openings 72 and 74 to enable the container sides to be drawn together until limited or held in position by support axle 24. Another example of retaining means is shown in FIG. 4 and will be described in more detail below.

Turning now to FIG. 3, the cooperation between retaining assembly 34 and support axle 24 may be described in more detail. Support axle 24 is inserted into central opening 16. Opposed ends 28, 30 abut the interior surfaces of opposed container side walls 20 and 22, preventing the passage of wire between opposed end 28, 30 and opposed side wall 20, 22. The retaining assembly 34 further cooperates with axle 24 so that wire from the outermost coils cannot become jammed between coil 13 and sides 20, 22.

Tightening first and second retaining members 36, 38 against the container provides lateral support for the opposed side walls and prevents outward bowing. If the opposed ends do not quite reach the opposed side walls when the support axle is inserted in place, the first and second retaining members press the container walls in towards the support axle. The flexibility of the container ensures that the support axle will be sandwiched between and support the opposed side walls.

As an optional feature, apertures 72, 74 have been formed in first and second retaining members 36, 38. These apertures are positioned and dimensioned to allow wire dispensing apparatus 10 to be placed on a traditional wire caddy (not shown). Once the retaining device is mounted to the container, the wire dispensing apparatus can be placed on a wire caddy with the caddy spindle passing through apertures 72 and 74 and piercing holes in the opposed side walls of the container. Alternatively, holes may be cut in opposed side walls 20 and 22 prior to mounting the apparatus on the wire caddy.

Turning now to FIG. 4, an alternative embodiment of the wire dispensing apparatus of the present invention is represented. In this embodiment, the support axle means and the retaining means are coupled together. The support axle includes complementary configured axle members 76, 78 dimensioned for insertion into the central opening of the coil. Axle members 76 and 78 are cooperatively threaded, and may be secured together by inserting axle member 78 into the axle member 76 and turning one relative to the other to tighten the two together. Axle members 76 and 78 have laterally extending first and second retaining members or flanges 36*a* and 38*a* integrally formed therewith.

To mount wire dispensing apparatus 10*a* to container 12*a*, axle receiving holes, such as hole 80, are first cut in opposed side walls 20*a*, 22*a* at the approximate location of the central opening of the coil. Axle members 76, 78 are inserted through hole 80 and the opposed aligned hole and into the central opening of the coil and tightened together. Retaining flanges 36*a* and 38*a*, which are larger in diameter than hole 80, abut the outer surface of opposed side walls 20*a*, 22*a* and secure the axle members in a position causing side walls 20*a*, 22*a* not to squeeze and yet not to be too far from the side of the coil of wire.

Since axle members 76 and 78 are integrally formed with retaining members 36*a* and 38*a*, any passage of wire between axle members 76, 78 and opposed side walls 20*a*, 22*a* of the container is prevented. Thus, the wire will not cross the central opening of the coil as the coil is unwound, and the close spacing of sides 20*a*, 22*a* next to the coil sides prevents jamming of wire between the coil and the container sides. Instead, the wire or cable is payed out by rolling around axle 76, 78 or by rotating the axle with respect to container 12*a* upon pulling the outer end of the wire tangentially with respect to the coil within the container.

In this embodiment of the present invention, retaining discs of flanges 36*a* and 38*a* do not include apertures 72, 74. However, such apertures may be added to retaining members 36*a* and 38*a* for mounting of this form of the wire dispensing apparatus on a traditional wire caddy.

The retaining members of the present embodiment are formed as round discs or flanges, however, other shapes and configurations may be substituted. Additionally, the cooperative threading may be replaced with other means known in the art for securing the axle members together, such as bayonet connections or the like. Still further the flanges can be coupled to the axle members, rather than integrally formed therewith.

An embodiment of a retaining and/or carrying device 84 for transporting wire dispensing apparatus 10 is shown in FIG. 5. The carrying device includes adjustable straps 48, 50 connected together by handle 70. Adjustable fastening means, such as fastening clips 52, 54 having male and female members 56, 58 are used to bind the adjustable straps about the wire dispensing apparatus.

The carrying device is mounted to the wire dispensing apparatus by wrapping the adjustable straps around the container and inserting the male members into the female members of the fastening clips. The adjustable straps are then tightened about the container by pulling loose ends 60, 62. Any slack in the adjustable straps are removed as the straps are pulled through the female members and buckles 86, 88. Once the straps have been properly tightened, the buckles prevent the adjustable straps from loosening while the carrying device is mounted to the wire dispensing apparatus.

As can be seen in FIG. 1, carrying device 84 has been incorporated into the illustrated embodiment of the wire dispensing apparatus, with retaining members 36, 38, 40 and 42 mounted to strap assembly 84. Carrying strap assembly 84 also may be mounted to wire dispensing apparatus 10*a* for facilitating the transportation and manipulation of the combined container and dispensing apparatus. Additionally, carry strap assembly 84 of the present invention may be mounted to a wide variety of other devices for easy handling.

As will be apparent from the above description of apparatus 10 for converting a conventional wire storage container 12 into a wire dispenser, the method of the present invention is comprised of two steps. Insertion of a support axle 24 into central coil opening 16 provides stable support for positioning of container side walls 20 and 22, while mounting a retaining assembly 34 to the exterior of container 12 further supports the opposed sides. The axle and retaining assembly cooperate to enable use of the container walls to create a dispensing reel or spool. A wire dispensing turntable is essentially built in the container by supporting the container walls in a manner creating a spool or reel for the cable.

What is claimed is:

1. An apparatus for converting a wire storage container having spaced apart opposed side walls into a spool type wire dispensing assembly for dispensing an annular coil of wire stored in said container comprising:

support axle means dimensioned for insertion into a central opening defined by innermost coils of said coil of wire, said axle means having opposed ends and a length dimension therebetween about equal to the height dimension of said coil of wire; and retaining means mountable to an exterior of said side walls in generally aligned relation to said opposed ends of said axle means, said retaining means, when mounted to said container, cooperating with said axle means to prevent passage of said wire around said opposed ends of said axle means and between said side walls and sides of said coil of wire during paying out of said wire from said dispensing assembly.

2. The apparatus of claim 1 wherein said retaining means cooperates with said axle means by supporting said opposed side walls in sufficiently close proximity to said opposed ends of said axle means to prevent passage of said wire between said opposed ends of said axle means and said opposed side walls.

3. The apparatus of claim 2 wherein said retaining means includes first and second retaining members mountable to the exterior of said container in general alignment with said opposed ends of said axle means, and at least one place when mounted on a variety of said containers each having a different distance separating said opposed sides.

4. The apparatus of claim 3 wherein said retaining means further includes third and fourth retaining members mountable to the exterior of said container, said third retaining member having an opening for dispensing said wire therethrough and a handle for facilitating manipulation of said container.

5. The apparatus of claim 1 wherein one of said axle means and said retaining means extends through said opposed side walls, and said retaining means is coupled to said opposed ends of said axle means.

6. The apparatus of claim 1 wherein said dispensing apparatus includes a coil of wire mounted on said axle means and stored within a container, and said retaining means is mounted to the exterior of said container.

7. The apparatus of claim 1 wherein at least one of said axle means and said retaining means includes an aperture configured for the placement of said dispensing assembly on a wire caddy for dispensing said wire from said container.

8. An apparatus for dispensing wire from an annular coil encased within a storage container, said apparatus comprising:

an annular coil of wire having a central opening defined by the innermost loops of said coil;

support axle means inserted into said central opening and having opposed ends jutting out from said central opening;

a storage container having spaced apart opposed side walls enclosing said coil with said central opening lying between said opposed side walls, and with said ends of said axle means reaching at least the proximity of said opposed side walls; and retaining means mounted to an exterior of said container in general alignment with said central opening of said coil, said retaining means interacting with said axle means to prevent the passage of said wire around said ends of said axle means and between sides of said coil of wire and said side walls during paying out of said wire from said container.

9. The apparatus of claim 8 wherein said retaining means interacts with said axle means by supporting said opposed side walls of said container in sufficiently close proximity to said opposed ends of said axle means to prevent passage of said wire between said opposed ends of said axle means and said opposed side walls while permitting rotation of said coil of wire in said container.

10. The apparatus of claim 9 wherein said retaining means includes first and second retaining members mounted to the exterior of said container in general alignment with said opposed ends of said axle means, and at least one adjustable strap securing said retaining members in place on said container, said adjustable strap being configured for tightening said retaining members about a variety of said containers each having a different distance between said opposed side walls.

11. The apparatus of claim 8 wherein one of said axle means and said retaining means extends through said opposed side walls, and said retaining means is attached to said opposed ends of said axle means.

12. The apparatus of claim 8 wherein at least one of said axle means and said retaining means includes an aperture configured for the placement of said dispensing assembly on a wire caddy for dispensing said wire from said container.

13. A method for converting a wire storage container into a wire dispensing assembly for dispensing an annular coil of wire stored in said container comprising the steps of:

while said coil of wire is positioned in said container with a central opening defined by the innermost loops of said coil oriented to extend between spaced apart opposed side walls of said container, inserting a support axle into said central opening with opposed ends of said axle jutting out from said central opening; and mounting a retaining device to the exterior of said container in a position cooperating with said support axle to prevent the passage of wire around said ends of said axle and between said side walls and said coil while dispensing said wire from said dispensing assembly by pulling an outermost end of said wire tangentially to said coil within said container.

14. The method of claim 13 wherein said mounting step includes positioning first and second retaining members of said retaining device adjacent said opposed sides near said opposed ends of said axle and securing said first and second retaining members in place by tightening at least one adjustable strap about said container.

15. The method of claim 14 wherein said mounting step includes positioning third and fourth retaining members of said retaining device against the exterior of said container and securing said third and fourth retaining members in place by tightening said adjustable strap.

16. The method of claim 13 wherein said inserting step includes passing one of said axle and said retaining device through an opening in each of said opposed side walls and wherein said mounting step includes attaching said retaining device to said opposed ends of said axle.

17. The method of claim 13 wherein said mounting step includes placing said dispensing assembly on a wire caddy.

* * * * *

UNITED STATES PATENT AND TRADEMARK OFFICE

CERTIFICATE OF CORRECTION

PATENT NO. : 5,139,210

DATED : August 18, 1992

INVENTOR(S) : Henry D. Schaffer

It is certified that error appears in the above-identified patent and that said Letters Patent is hereby corrected as shown below:

Column 8, line 56, after "one" insert ---adjustable strap for securing said retaining members in---.

Signed and Sealed this

Seventeenth Day of August, 1993

Bruce Lehman

*Attest:*

BRUCE LEHMAN

*Attesting Officer*

*Commissioner of Patents and Trademarks*